United States Patent [19]

Omdoll et al.

[11] Patent Number: 4,706,844

[45] Date of Patent: Nov. 17, 1987

[54] NAPKIN DISPENSER

[75] Inventors: Paul A. Omdoll, Palmyra; Scott J. Collins, Milwaukee, both of Wis.

[73] Assignee: San Jamar, Inc., Elkhorn, Wis.

[21] Appl. No.: 758,430

[22] Filed: Jul. 24, 1985

[51] Int. Cl.[4] ..... B65H 1/12

[52] U.S. Cl. ..... 221/59; 221/45; 221/55

[58] Field of Search ..... 221/33, 44, 45, 47, 221/51, 52, 55, 56–59, 63, 303, 304, 35

[56] References Cited

U.S. PATENT DOCUMENTS

| | | | |
|---|---|---|---|
| 2,027,674 | 1/1936 | Broeren | 221/55 |
| 2,108,825 | 2/1938 | Morris | 221/59 |
| 2,547,856 | 4/1951 | Cofrin et al. | 221/59 X |
| 2,852,158 | 9/1958 | Jones et al. | 221/59 X |
| 3,203,586 | 8/1965 | Downham | 221/56 X |
| 3,208,636 | 9/1965 | Filipowicz | 221/57 |
| 3,291,339 | 12/1966 | Hein | 221/59 X |
| 3,370,748 | 2/1968 | Koerper et al. | 221/59 |
| 3,777,931 | 12/1973 | Fleming | 221/57 |
| 4,094,442 | 6/1978 | Radek | 221/59 |
| 4,311,252 | 1/1982 | Hope, Jr. et al. | 221/59 X |
| 4,343,415 | 8/1982 | Radek | 221/59 |

*Primary Examiner*—Joseph J. Rolla
*Assistant Examiner*—Kevin P. Shaver
*Attorney, Agent, or Firm*—Penrose Lucas Albright Pravel, Cambrell, Hewitt, & Kimball

[57] ABSTRACT

A distribution cover for a napkin dispenser is in the form of a four-sided member, with three sides conforming to three sides of a truncated, four sided pyramid. The fourth side of the member is a relatively broad, gently sloping face at relatively angle to the base of the cover. A dispensing opening is formed in the lower aspects of this face of the member. A drag area in the form of a step in this face is created on the distribution cover adjacent and below a lower rim of the dispensing opening. Napkins are slightly confined for dispensing along three outer edges by the sides of the pyramid and over a surface area adjacent the opening the drag area. A spring loaded napkin storage container urges napkins against the distribution cover. The cover can dispense napkins of different sizes without adjustment and dispense napkins with reduced likelihood of tearing. The napkins are also removable at different angles from the cover without tearing.

19 Claims, 3 Drawing Figures

NAPKIN DISPENSER

BACKGROUND OF INVENTION

1. Field of the Invention:

The present invention relates to napkin dispensers.

2. Description of the Prior Art:

Napkin dispensers have been commonly used in restaurants and other locations for dispensing disposable paper napkins. While napkin dispensers may appear uncomplicated at first glance, a number of problems have been associated with their use. In the past, napkin dispensers have been known to jam, i.e., napkins within the dispenser could not be removed without either disassembly of the dispenser or forcing the jam loose, which resulted in the destruction of at least several napkins. Jamming often occurred due to overloading of the dispenser or from using a wrong napkin size in the dispenser.

Prior napkin dispensers have also been known to tear and shred napkins as they are removed from the dispensers. Shredding of napkins was often due to the force required to be exerted on the napkins to overcome gripping forces holding the napkin in the containers. Shredding also occurred when napkins were withdrawn from the side of a dispensing opening in the dispenser rather than withdrawing the napkin directly from the front of the dispensing opening. Users, such as customers in fast food restaurants, typically did not take time to exert the direct forward pull required to prevent shredding by most dispensers. Another common problem was removing the precise number of napkins desired. All too often the user withdrew far more napkins than desired, for example because a number of the napkins stuck or were jammed together and came as a group from the dispenser. These problems lead to waste of napkins. Restaurant and service personnel were forced to spend unnecessary time cleaning up torn, unwanted and excess napkins about dispensers.

SUMMARY OF INVENTION

The present invention provides a distribution cover for dispensing napkins adapted to fit on a napkin storage container. The distribution cover has an opening through which napkins may be withdrawn and the napkin container has a spring or other biasing means to urge the napkins into contact with the distribution cover.

The distribution cover is provided in the form of an elongated offset pyramid shape. Napkins in the storage container are urged into a convex underside of the pyramid. A first one of the sides of the pyramid is substantially larger and flatter than the others. The napkins are removed from the dispenser through a dispensing opening in this first side. The remaining three sides of the pyramid are more upright and serve only to guide and hold the napkins lightly about three sides of their outer periphery. This allows various sizes of napkins to be used in the dispenser, decreasing the risk of overloading, and tends to cause the napkins to separate from the next lower one as they are removed. A drag or surface contact area is provided in the form of a relatively flat area beneath the first side adjacent and below the dispensing opening. The drag area contacts the napkins over a surface area extending inward from their fourth side, exerting a gripping force in opposition to that from the biasing spring in the dispenser container. The napkins tend to curve upwardly from the drag area into the dispensing opening. This further tends to separate the napkins so that they may be removed individually or in volume with a minimum of pressure and effort, while minimizing the risk of shredding, tearing, or jamming.

The opening in the distribution cover of the napkin dispenser is trapezoidal in nature. The opening has rounded corners of an optimum radius and a curved lip at its perimeter which protrudes outwardly away from the dispenser cover. These features allow napkins to be withdrawn at angles to the opening while significantly decreasing problems of tearing or shredding.

DESCRIPTION OF THE PREFERRED EMBODIMENT

Figure 1:
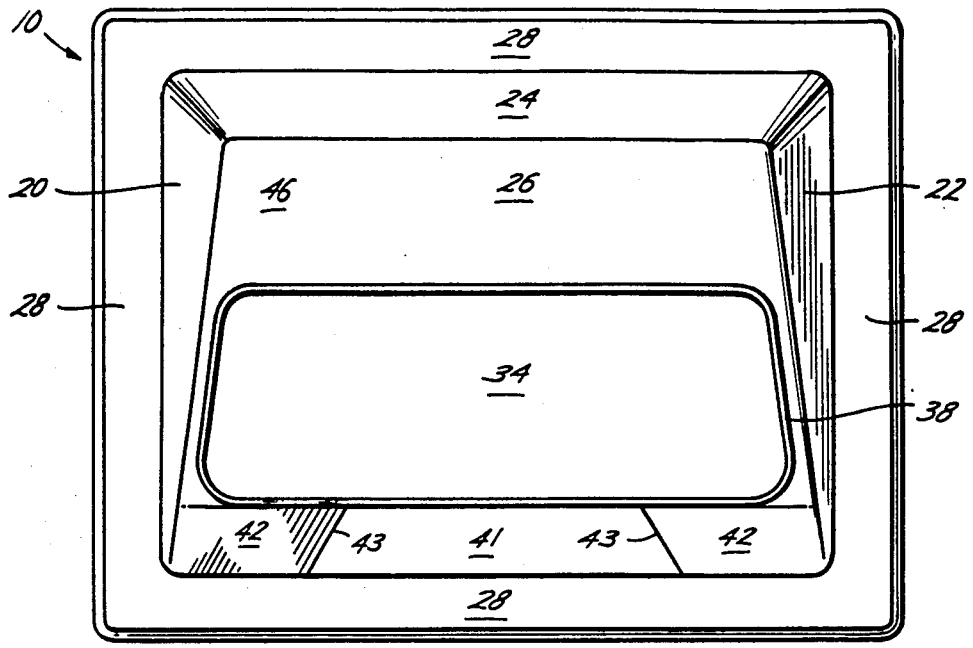
FIG. 1 is a plan view of the distribution cover of the napkin dispenser of the present invention.

In the drawings, a napkin dispenser 10 according to the present invention is shown, which comprises a napkin dispenser body 12 and a dispenser cover 14. The dispenser body 12 provides an interior storage area 16 for napkins which are to be dispensed through the distribution cover 14. The napkins to be dispensed rest on a support plate 17 in the dispenser 10 and are urged upwardly toward the distribution cover 14 by means of a spring 18. The spring 18 is usually a low compression spring which causes support plate 17 to function as a pusher plate. The spring 18 is held in place between the plate 17 and a spring support plate 19 at the bottom of dispenser body 12 by tabs or other suitable attachment mechanisms.

Distribution cover 14 is a one piece member, preferably made of die cast metal for strength and durability. The distribution cover 14 in the form of an offset, truncated pyramid having three upwardly extending, inwardly tapering sides 20, 22, 24 and a larger, more gently sloping top surface 26 as a fourth side of the pyramid. Outer flanges 28 are formed extending from each side of the cover 14 to rest on and cover a mating container flange 30 on the napkin container 12. The container flange 30 is adapted to rest on a surface 31 of a counter or the like so that the dispenser body 12 may be recessed beneath the surface of the counter. Side rims 32 extend upwardly from the flanges 28 to allow a topmost portion napkins from an open top of dispenser body 12 to be received within the dispenser cover 14 before engaging sides 20, 22, 24 and top 26 of the distribution cover.

Sides 20, 22 and 24 extend upwadly from surface 32 at an angle of about sixty degrees from the plane of the open top of dispenser body 12 and converge inwardly toward each other. The edges or peripheral surfaces of the three sides of the napkins which contact the interior surfaces of the angled sides 20, 22 and 24 are subjected to little, if any, force other than a confining or guiding one. This tends to fan or spread these three edges of the napkins from each other to aid in dispensing. It also allows the napkin dispenser 10 to accept napkins of sizes which may vary as much as approximately one-half inch without sacrificing dispensing ease and convenience.

The sides 20, 22, and 24 truncate at their point of intersection with the fourth side or top surface 26. The side 24 is of a height along its top equal to the highest extent 20*a* and 22*a* of the sides 20 and 22, respectively. This height defines the slope of top surface 26 generally at an angle, on the order of ten degrees, to the plane of the face of the napkins on the plate 17 in storage area 16. The angle of surface 26 allows napkins to lean slightly toward a dispensing opening 34 in the surface 26 again causing a fanning or spreading effect on the topmost napkins. This fanning or spreading effect decreases the force necessary to slide one napkin along and away from another napkin as the napkins are dispensed. An optimum angle of slope for the top 26 of the distribution cover 14 has been found to be about ten degrees to the plane of the face of the napkins as they lie on plate 13.

The distribution opening 34 in top surface 26 of the distribution cover 14 is formed in a lower aspect or portion of its sloping surface. The opening 34 is generally trapezoidal in shape (FIG. 1) and extends substantially the width of the top surface 26 between sides 20 and 22. The opening 34 is wider toward a lower side of surface 26 than at its upper portion. Opening 34 has rounded corners to decrease the risk of tearing napkins upon removal. Rounded corners of a one-half inch curvature have been found to be most effective for standard 8"×5" or 8"×6" napkins. A curved rim 38 is formed flaring upwardly from surface 26 about the perimeter of opening 34 to further inhibit tearing or shredding of napkins and aid in removing napkins from the dispenser.

Figure 2:
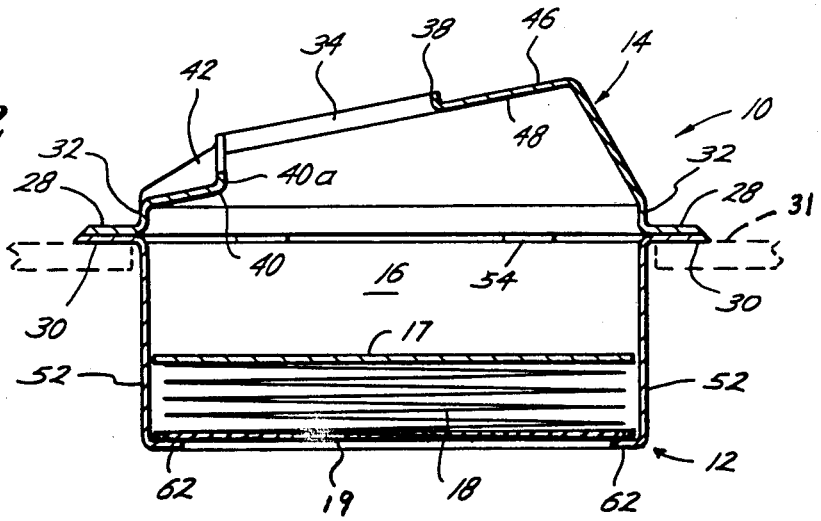
FIG. 2 is an elevation view, taken partly in cross-section, of the napkin dispenser of the present invention.
Figure 3:
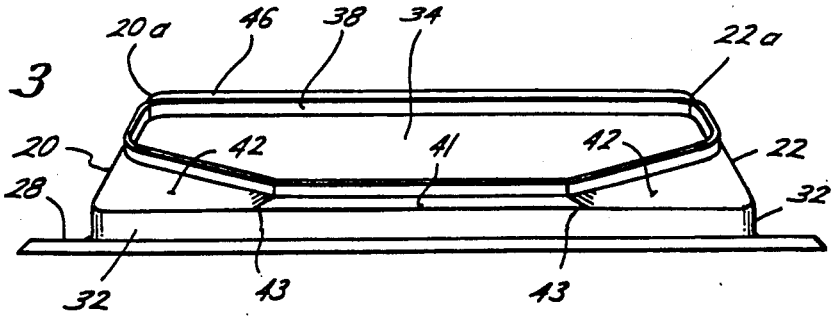
FIG. 3 is an elevation view of the distribution cover of the napkin dispenser of the present invention.

An inside surface 40 beneath a step or central portion 41 of sloped top surface 26 of distribution cover 14 is a drag area or contact surface. Downwardly sloping face portions 42 (FIGS. 2 and 3) of surface 26 extend inwardly from the sides 20 and 22 to the central portion 41 forming transition lines 43 where central portion 41 intersects them. The slope of face portions 42 causes the rim 38 to appear to extend forward (FIG. 3) in the elevation view but such is not the case (FIG. 2). Central portion 41 above drag area 40 is thus a depression in the top surface 26 below opening 34 and rim 38 on a lower portion of the top surface 26. The drag area 40 extends approximately one half the width or breadth of opening 34 centered along the center of opening 34. The drag area 40 has a rounded upper edge 40*a* which allows napkins to slide more easily outer of the opening 34. The rounded edge 40*a* of drag area 40 is positioned about one-half inch below the rim 38 about opening 34 and lightly contacts the surface of napkins being dispensed. Preferably, the rounded edge 40*a* lies on a plane angled about twenty degrees to the plane of the napkins as stored in the storage area 16.

The drag area 40 causes the napkins proximate to the distribution cover 14 to bow slightly upwardly and form a concave curved surface in the area of opening 34. Since the drag area 40 is less wide the napkins, and the opening 34, and is depressed from the plane of an upper portion 46 of the top surface 26, thus allowing pressure from spring 18 to tend to cause the napkins contacting the drag area 40 to curve upwardly along portions beneath the sloped face portions 42 about the width of opening 34. Thus, the napkins are held lightly around their periphery by contacting sides 20, 22 and 24, and firmly, but slidably, by the drag area 40. The central upper portion of the napkins may or may not contact an inner surface 48 beneath the upper portion or aspect 46 of the top surface 26. The position of the drag area 40 and the converging nature of sides 20, 22, 24 and the top surface 26 of the distribution cover 14 cause the napkins to be confined in a curved and fanned or spread manner for dispensing. This decreases the force necessary to remove napkins from the container and allows removal of a selected number of napkins with ease.

It is to be noted the drag area 40 is located along only a portion of the width of opening 34. Thus, napkins can be more readily withdrawn from opening 34 at side angles to the napkins dispenser 10 in addition to directly outwardly in a direction perpendicular to the plane of plate 17. The sloping portions 42 of surface 26 at each side of central portion 41 further increase the ease with which napkins may be removed at angles to the dispenser 10.

The napkin dispensing body 12 has four side walls 52 about the storage area 16 with an open top at one end through which napkins may pass into the distribution cover 14. One of the side walls 52 is connected to one of the flanges 28 of the distribution cover 14 by a hinge and latch mechanism 54 or other suitable connector to allow the napkin dispenser 10 to be opened and loaded with more napkins.

The flanges 30 of dispenser body 12 are formed extending laterally outwardly at the top of the four side walls 52 so that the napkin dispenser 10 may be mounted in an opening in any suitable surface such as a wall, cupboard, or countertop 31. Napkin dispenser 10 can be mounted in a surface of any orientation, but the preferred orientation of the distribution cover 14 is one in which the drag area 40 is positioned oriented toward a user when on a horizontal surface or at a lower position when mounted on a wall.

Inwardly extending flanges or rims 62 are formed at lower ends of the side walls 52 opposite flanges 30 to provide support for the spring support plate 19.

The preferred embodiment of the invention contemplates the dispensing of off-fold paper napkins with dimensions of 8"×5" or 8"×6". Correspondingly, it is contemplated that the area within side rims 32 is 7.125" and 5.25". The width of the narrowest portion of the top surface 26 of the distribution cover 28 is 5.750". The widest portion of opening 34 is 6.062" and the depth of opening 34 is 2.312". Note in FIG. 1 that opening 34 conforms to the trapezoidal shape of top surface 26. Thus, the length of the narrow side of opening 34 is 5.812". Also, the maximum height of the cover 14 is 1.625" and the width of the drag area 40 is 3.0". The contemplated radius for the curved rim 38 about opening 34 is 0.187" with a width of 0.175", and the width of surface 32 is 0.375". The distribution cover 14 may be chromium plates or provided with other protective coverings such as teflon to reduce friction and aid in cleaning dispenser surfaces.

In operation, the napkin dispenser 10 is loaded with a stack of napkins of a thickness approximately equal to the depth of the dispenser body 12 oriented parallel to pusher plate 17. Pusher plate 17 is depressed against spring 18 until the volume of napkins fills the container 12.

Once the napkin dispenser 10 is loaded the spring 18 urges the pusher plate 17 and napkins stored in the storage area 16 toward the distribution cover 14 such that the front napkin in the storage area 16 contacts the drag area 40 and several of the napkins proximate to the distribution cover 14 contact sides 20, 22, 24 about three sides of their periphery. Because the drag area 40 lies in the flat plane of napkins as they come out of the container 12 and is shorter than the width or length of the napkins which contact it, the napkins tend to form a convex curve about the drag area 40. This curve generally extends from the side 20 to the side 22 in a line along the width the opening 34. Furthermore, because the drag area 40 contacts the napkins at a location removed from their center, i.e., at a position near the periphery of the napkins, and because of pressure exerted by spring 18, the napkins tend to curve or fan about drag area 40 into the cavity formed by the inner and spread surfaces of the sides 20, 22, 24 and top 26. The napkins thus tend to curve in both a lateral and longitudinal direction in the opening 34.

Since the top surface 26 is a sloping one, that portion of the napkins in dispenser cover 14 tend to spread from each other along their edges adjacent the side 24. The resulting angled orientation or spreading of the napkins with respect to their normal storage plane causes the napkins to to more easily tend to separate. The combination of the convex curve into which they are forced by drag area 40 and the spread position in which the napkins are placed along one side by the distribution cover 14 further tends to separate the napkins. This curved spread position decreases the contact pressure between napkins directly beneath the distribution cover 14 and allows a user to easily grasp the precise number of napkins desired and remove them from the dispenser 10 with a minimum of effort. Furthermore, the curved, spread position greatly reduces the risk of tearing or shredding the napkins or of jamming the dispensers.

Other features also decrease the risk of shredding, tearing, or jamming of napkins. Again, note that the drag area 40 provides substantially the entire contact force holding the napkins in position. Thus, while the upper periphery of the napkins in contact with sides 20, 22 and 24 may be relatively easily removed from the dispenser, the drag area 40 provides greater resistance. It is the drag area 40 against which the consumer pulls the napkins during removal. Because the drag area 40 is located only along a portion of the width or extent of opening 34, the drag area 40 does not contact other portions of the napkins nearer the sides 20 and 22. This allows the napkins to be withdrawn at angles to the distribution cover 14 without placing tension in the edges of the napkin which contact the sides of the opening 34 hear the sides 20 and 22. Lessened tension on the edges of the napkins as they are removed decreases the tendency of the napkins to tear along edges during removal. Furthermore, placement of the drag area 40 directly behind the edge of opening 34 in the direction of napkin withdrawal tends to reduce the number of surfaces the napkin must traverse to exit the dispenser. The greatest width of opening 34 is positioned proximate the drag area 40 to also give the napkin the widest possible space for removal.

The ends of the drag area 40 are slightly angled so as to converge toward the general withdrawal direction of napkins. This further decreases resistance to withdrawal of napkins at angles to the front face of dispenser 10. Additionally, in operation, as the napkin is withdrawn, the rim 38 of opening 34 is formed in an outwardly extending curve. This feature, in combination with the rounded corners 36 of opening 34 further reduces the risk of shredding or tearing of napkins as they are removed from the dispenser.

The foregoing disclosure and description of the invention are illustrative and explanatory thereof, and various changes in the size, shape and materials, as well as in the details of the illustrated construction may be made without departing from the spirit of the invention.

Having disclosed our invention, what we claim as new and to be secured by Letters Patent of the United States is:

1. A dispenser for paper napkins, comprising the following:

(a) a container for the paper napkins having an open top and containing spring biased means which urges the napkins in said container toward said open top;

(b) a distribution cover for said container which comprises the following:

a peripherial portion;

a body portion extending outwardly from said peripheral portion, said body portion having an outer face and an opening formed therein, said outer face disposed at an angle to said open top of said container, said opening being located in a lower part of said outer face, said outer face having an upper part extending above and higher than said opening and said lower part;

said body portion having interior surfaces for contacting the edges of napkins urged against said interior surfaces from said container, the interior surface of the rear side of said upper part being inclined upwardly and inwardly so as to be at an obtuse angle to the interior surface of the top of said upper part;

said lower part of said body portion having on its interior face below said opening a centrally disposed drag area for engaging napkins urged against same from said container, said drag area being depressed relative to outboard portions of the interior face of said lower part which are located outboard of said drag area;

said drag area engaging the napkins inwardly along a surface extending from one of their edges, and providing a pressure surface between the napkins and said body portion for receipt of pressure from said spring biased means of said container and said drag area further retaining the napkins so that their rear edges are fanned out where they engage the interior surface of said rear side.

2. A dispenser in accordance with claim 1 wherein an upwardly flared edge of said outer face is formed adjacent to and surrounding said opening.

3. A dispenser in accordance with claim 1 wherein said lower part of said outer face is disposed at an angle of about 10° relative to a horizontal plane adjacent thereto.

4. The dispenser of claim 1, in which said drag area urges the napkins into a curve about an axis substantially perpendicular to the axis of said opening.

5. A dispenser in accordance with claim 1, wherein said opening, as seen in plan, conforms generally to a trapezoid with curved corners, the longer of the parallel sides of said trapezoid being lower than the shorter of such parallel sides, the non-parallel sides of said trapezoid being adjacent and substantially parallel to lateral sides of said body portion, said lateral sides converging upwardly.

6. A dispenser in accordance with claim 5 wherein said corners are curved on a radius of about one-half inch.

7. A dispenser in accordance with claim 5, wherein a central portion of said opening on its lower side is in the immediate vicinity of said drag area, and wherein said central portion of said opening, as seen in front elevation, is lower in the vicinity of said drag area than at the side portions of said lower side which are located outboard of said central portion.

8. A dispenser for paper napkins comprising the following:

(a) a container for the paper napkins having an open top and a resiliently biased means which urges the napkins in said container outwardly toward said open top;

(b) a distribution cover for said container comprising the following:

connection means connecting said cover to said container;

a body portion extending above said open top for receiving napkins therefrom;

said body portion being generally rectangular as seen in plan and having four upwardly, inwardly extending, sloping sides for engaging and spreading the edges of said napkins and a top face on one of said sides which is inclined with respect to said open top and has an opening in its lower aspect for dispensing napkins, the other of said sloping sides comprises a rear and two lateral sides joined at their top edges to the top face of said one of said sides;

said opening being of trapezoid configuration as seen in plan, wider at the bottom side than the top side of said trapezoid and having rounded corners, one of said upwardly, inwardly-extending sloping sides being at least in part parallel to and lower than said bottom side of said body portion's opening to define on its lower surface a downwardly-depressed drag area wherein napkins are urged against the interior of said body portion at their edges and against said body portion's drag area at a location spaced inboard from corresponding edges of such napkins, said drag area holding the napkins so that they are fanned out and their edges engage the interior surface of the rear and lateral sides of said sloping sides.

9. A dispenser in accordance with claim 8 wherein said rounded corners of said opening have a radius of about one-half inch.

10. A dispenser in accordance with claim 8, wherein said opening is surrounded by an upwardly-flared lip, which in its uppermost aspect around said opening is approximately vertically oriented, the lip and the interior surface of the top face around said opening meeting at a juncture which provides a curved, sliding area around said opening for napkins that are withdrawn from the dispenser.

11. A dispenser for paper napkins that has a distribution cover with three sides, said three sides coinciding with three sides of a truncated, four sided pyramid having a rectangular base the same area as the cover, said distribution cover also having a top as a fourth side at the upper edges of said three sides that is at an angle to the horizontal and that has an opening for dispensing napkins in its lower aspect, the fourth side of the cover at its lower end having, at least in part, a lower drag and main holding area adajcent said opening and depressed so as to be spaced under said opening for napkins to be dispensed from the dispenser, a spring means in the dispenser biasing the napkins against said drag and main holding area, said napkins being sized relative to the cover such that said holding area retains the napkins due to said spring means so that their edges are fanned out where their edges contact said three sides.

12. The dispenser of claim 11, in which said distribution cover has a curved protruding rim adjacent to and surrounding the opening.

13. The dispenser of claim 11, in which said top is set an an angle of approximately 10° to the normal plane of the napkins as stored within the dispenser.

14. The dispenser of claim 11, in which the angle of said three sides of the distribution cover is about 60° relative to the normal plane of the napkins as stored in the dispenser.

15. The dispenser of claim 11, wherein said drag and main holding area extends along only a portion of one edge of the opening through which napkins are dispensed.

16. The dispenser of claim 11 wherein said opening through which napkins are dispensed is in the form of a trapezoid, as seen in plan, said opening being widest along the side proximate the drag and main holding area.

17. A dispenser in accordance with claim 11 wherein said three sides each converge towards each other from the rectangular base at an angle of about 60°.

18. A dispenser in accordance with claim 17 wherein said lower drag and main holding area is located at an angle of about 10° relative to the rectangular base.

19. A dispenser in accordance with claim 18 wherein an upper portion of the cover above said opening is in the plane of said opening.

* * * * *